US005191735A

United States Patent [19]

Ross

[11] Patent Number: 5,191,735

[45] Date of Patent: Mar. 9, 1993

[54] MOVABLE LOUVRE CLAMP

[75] Inventor: Alan Ross, Ontario, Canada

[73] Assignee: Dominion Plastics Inc., Woodbridge, Canada

[21] Appl. No.: 863,878

[22] Filed: Apr. 6, 1992

[51] Int. Cl.[5] ..... E05F 17/00

[52] U.S. Cl. ..... 49/74 L; 49/403

[58] Field of Search ..... 49/74 L, 90 PH, 403, 49/371; 454/221, 222, 224; 292/345

[56] References Cited

U.S. PATENT DOCUMENTS

| | | | |
|---|---|---|---|
| 173,806 | 2/1876 | Newhall | 292/345 |
| 2,205,156 | 6/1940 | Rowley | 292/345 |
| 2,290,713 | 7/1942 | Sayles | 49/90 PH |
| 2,496,921 | 2/1950 | Vicksell, Sr. | 49/403 |
| 2,700,803 | 2/1955 | Graham | 49/403 |
| 2,952,051 | 9/1960 | Scott | 49/403 |
| 2,952,885 | 9/1960 | Richardson | 49/403 |
| 3,371,446 | 3/1968 | Minds | 49/403 |
| 4,996,793 | 3/1991 | Mazur | 49/371 |

*Primary Examiner*—Renee S. Luebke
*Assistant Examiner*—Michael J. Milano

[57] ABSTRACT

A louvred structure comprises a frame with opposing styles supporting a plurality of moveable louvres having pivot pins fitted in pivot pin openings of the styles. At least one of the styles is provided with an interior flexible clamp extending lengthwise along the style and gripping a plurality of the pivot pins for holding a set position of the louvres.

3 Claims, 3 Drawing Sheets

MOVABLE LOUVRE CLAMP

FIELD OF THE INVENTION

The present invention relates to a structure with moveable louvres and means for holding a set position of the louvres.

BACKGROUND OF THE INVENTION

Louvred structures such as louvred doors and/or window shutters, etc. often include moveable louvres which pivot through an angle of slightly less than 180°. In most moveable louvre structures, the louvres are opened and closed in unison with one another by a control bar attached to the edges of the louvres. The control bar moves in an up and down direction to open and close the louvres. This control bar adds weight to one side of and imbalances the louvres. When the louvres are closed and the control bar is down as far as it will go, this does not present a problem. However, when the louvres are opened, the weight of the control bar provides a downward bias wanting to close the louvres.

Traditionally, the means for holding a set position of a moveable louvre is to provide strong frictional resistance between the louvre and its supporting frame. Typically, this is done by effectively clamping the frame tightly against the outside edges of the louvre. In certain constructions, and in particular, in vinyl constructions, it is neither desirable nor feasible to provide sufficient frictional resistance between the louver and the frame to hold a desired set louver position.

SUMMARY OF THE INVENTION

The present invention provides means specifically for holding louvre position without producing a binding action between the outside edge of the louvre and the frame supporting the louvre. More particularly, a louvred structure of the present invention comprises a frame with opposing styles supporting a plurality of pivotal louvres each having pivot pins fitted in pivot pin openings of the styles. At least one of the styles is provided with an interior flexible clamp extending lengthwise along that style and gripping a plurality of the pivot pins for holding a set position of the louvres.

The flexible clamp pin grip provided according to the present invention is particularly suited for use in the most up-to-date vinyl louvred shutters and doors.

BRIEF DESCRIPTION OF THE DRAWINGS

The above as well as other advantages and features of the present invention will be described in greater detail according to the preferred embodiments of the present invention in which.

DETAILED DESCRIPTION OF THE PREFERRED EMBODIMENTS

All of the structural components described below in detail have a vinyl or other similar plastic resin construction. However, it is to be appreciated that other materials could also be used.

Figure 1:
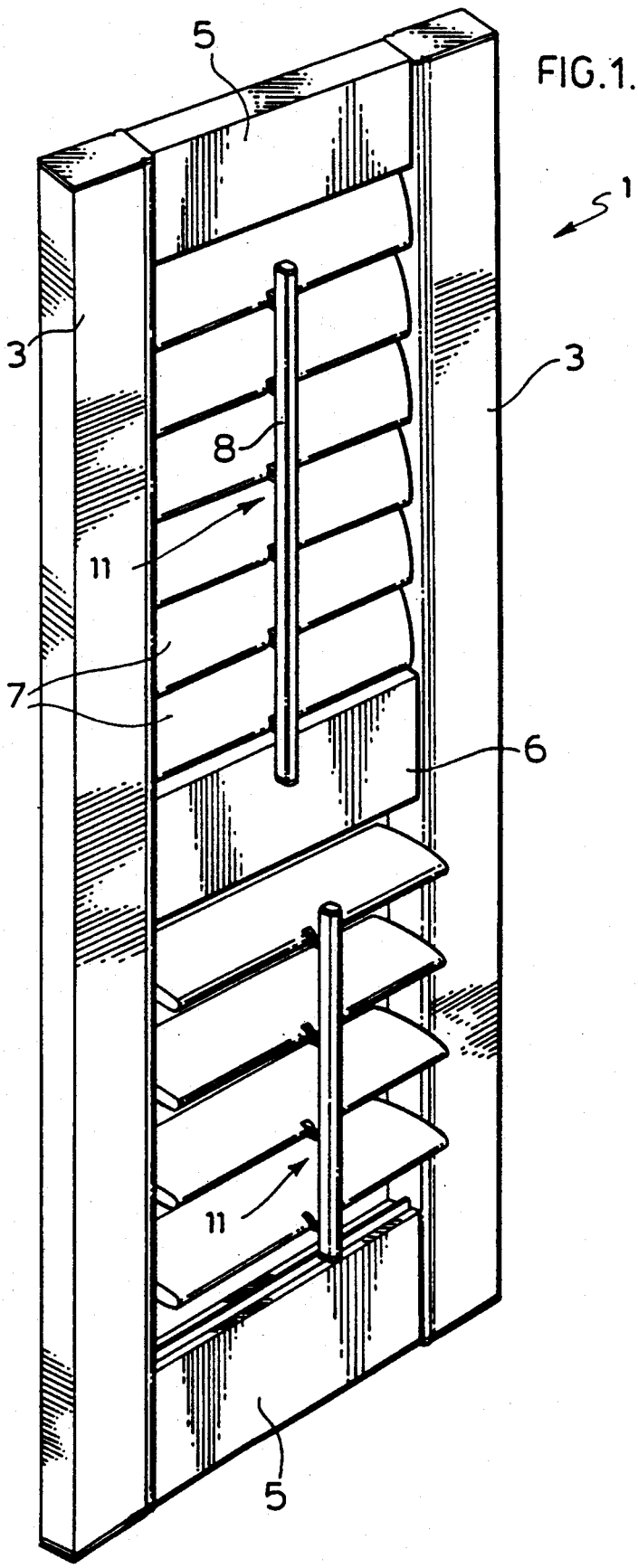
FIG. 1 is a perspective view of a shutter having moveable louvers and including an interior louver pin grip according to a preferred embodiment of the present invention.

FIG. 1 shows a shutter generally indicated at 1. This shutter is formed with a frame comprising styles 3, top and bottom headers 5 and a centre frame section 6. Pivotal louvres 7 formed in two groups, one above and one below the centre frame section are trapped between styles 3. The louvres in each group are moved by means of a control bar 8 connected to each louvre in that particular group. As will be seen in FIG. 1, the upper group of louvres is set to a closed position while the bottom group of louvres is set to an open position. In the case of the bottom group of louvres control bar 8 provides added weight attempting to close the louvres and pull them away from their set position. The frictional engagement of the frame on the outside edges of the louvres particularly when they are made of vinyl is generally not sufficient to hold a set position of the louvres. In the present invention, additional means interiorly of one of the styles is provided for holding the set louvre position.

Figure 2:
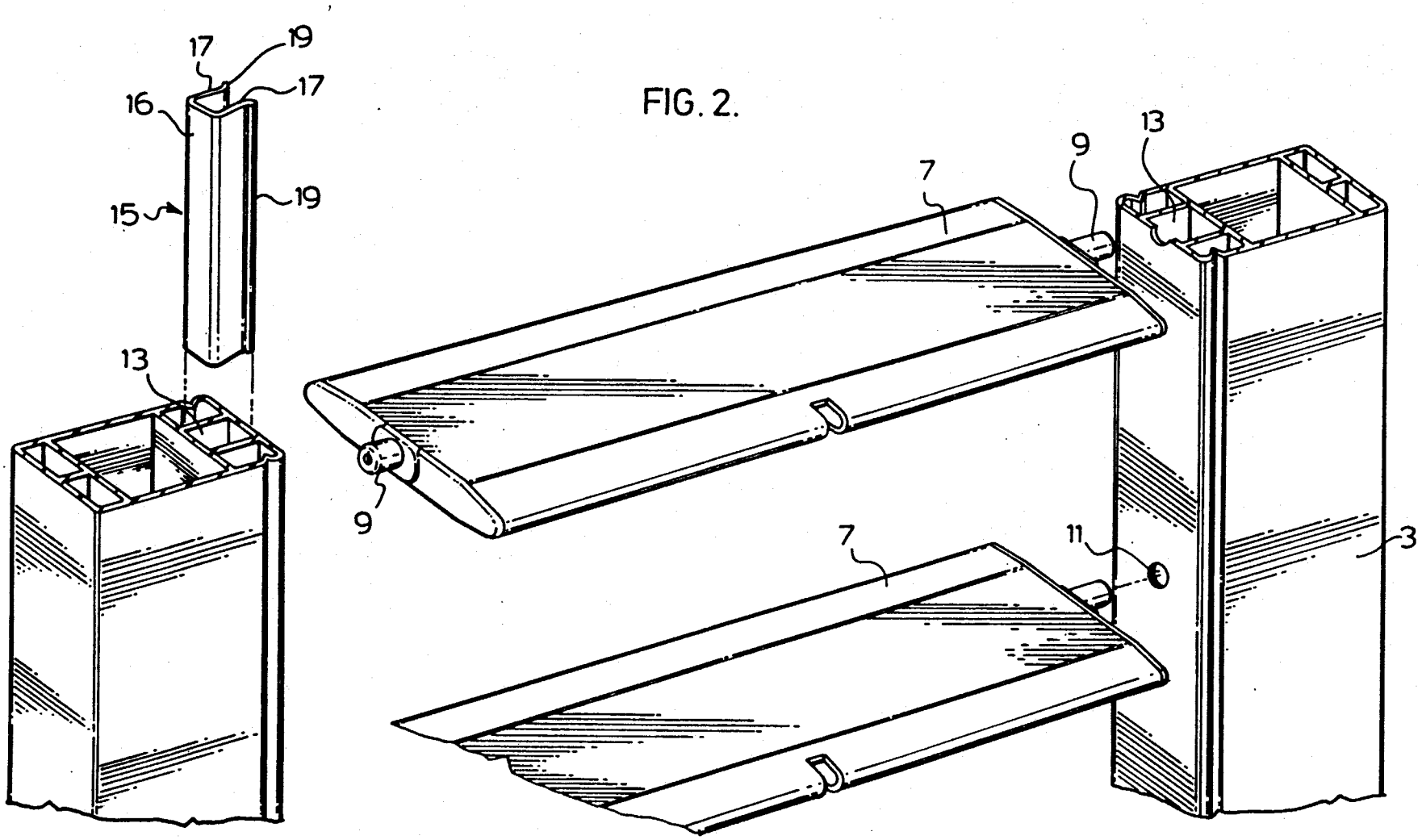
FIG. 2 is a sectional exploded perspective view of the shutter of FIG. 1.
Figure 3:
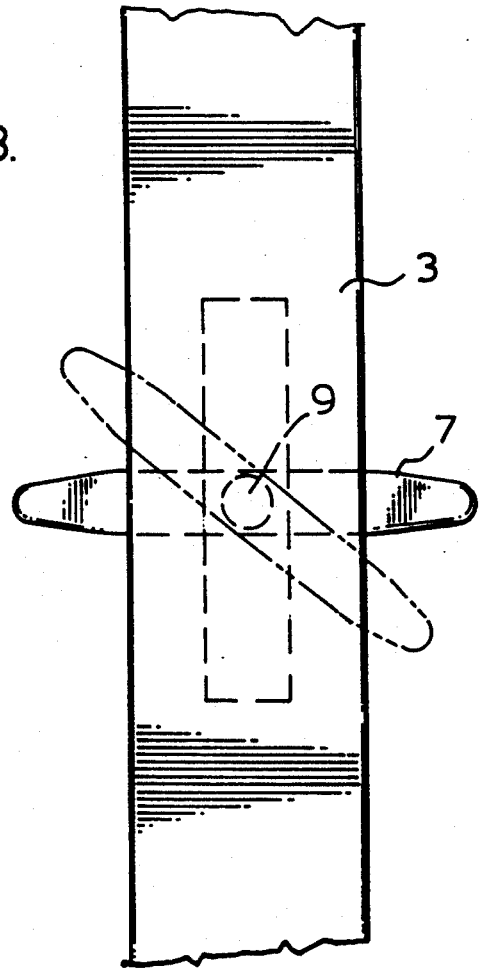
FIG. 3 is a side view showing different louver positions for the shutter of FIG. 1.
Figure 4:
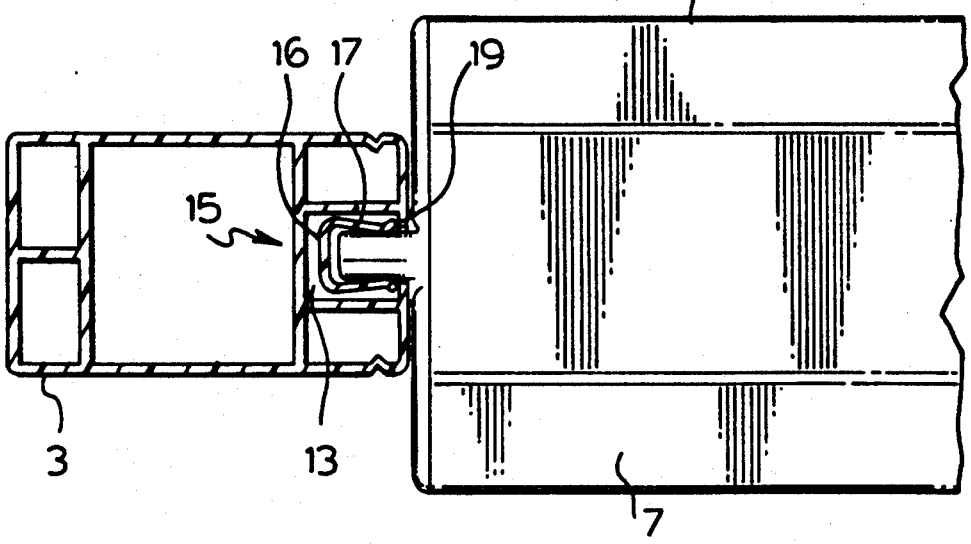
FIG. 4 is a sectional view looking down through the left hand assembled style and louvre set up of FIG. 2.

As best seen in FIGS. 2 and 4 of the drawings, each of the styles has a hollow interior construction. Each louvre includes louvre pivot pins 9 and each style includes a plurality of louvre pivot pin openings 11. These openings penetrate to a defined hollow region 13 within each of the styles. Located within one of the hollow regions 13 is a flexible plastic, e.g., vinyl pivot pin clamp 15 extending the full length of the style.

The pivot pin clamp 15 is in the form of a substantially U-shaped channel member including a base 16 and opposing side walls 17. Each of the side walls terminates with a slightly outwardly flared free end 19.

Clamp or grip 15 has as noted above a flexible construction. The base 16 substantially completely spans the width of hollow region 13 as best seen in FIG. 4 of the drawings. Side walls 17 of the clamp, when in their normally set position, are set at a gap less than the width of hollow region 13 and converge slightly towards one another. The minimum span between the two clamp arms 17 is less than the diameter across pivot pin 19 which, when fitted into one of the pivot pin openings, engages within clamp 15. The flared free ends 17 of the clamp provide a camming effect easing insertion of the pivot pin in the grip, the arms of which have to expand or open to receive the pivot pin. The clamp is therefore biased to close on and frictionally engage the pivot pin.

The same clamping effect is provided on all of the pivot pins on the clamp side of the structure. This provides more than sufficient resistance directly on the pivot pins to hold any desired set position for the louvres.

This use of a single elongated clamp is particularly efficient because it eliminates the need to have an accurate vertical fitting of an individual clamp at each louvre pin. The clamp extends past all of the pin openings in the style so that it automatically lines up with each pin opening to receive the louvre pins.

As can be seen from FIG. 2 of the drawings, each of the styles is equipped to accept one of the clamps 15 and therefore, if necessary, a clamp may be provided at both sides of the structure. The overall symmetry of the structure, including the louvres, louvre pins, louvre receiving opens and hollow construction of the styles allows for this feature.

Although the description above relates to a louvred structure in which all of the louvres are moveable in unison by means of a common actuator, i.e., control rod 8, the same louvre pin grip can be used in a structure where the louvres are not interconnected with one another and set to their own individual desired positions.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A louvred structure comprising a frame with opposing first and second styles, each style having an interior side with a plurality of pivot pin openings therethrough, a plurality of pivotal louvres having louvre pins fitted in the pin openings in said styles, at least said first style being hollow and fitted with a flexible louvre pin clamp extending lengthwise therealong, said clamp comprising an elongated body of flexible material defined by a pair of side walls and a clamp base to which said side walls are flexible connected, said side walls having free ends which diverge from one another forming a clamp mouth facing the interior side of and spanning a plurality of the pivot pin openings through said first style, said side walls converging toward one another between said clamp mouth and said clamp base to define a louvre pivot pin grip region narrower than said clamp mouth, said clamp mouth providing a cam guide of said louvre pivot pins into said grip region.

2. A louvred structure as claimed in claim 1 wherein said clamp has a flexible plastic construction.

3. A louvred structure as claimed in claim 1 wherein both of said first and second styles are hollow.

* * * * *